United States Patent [19]

Ichikawa

[11] 4,276,584

[45] Jun. 30, 1981

[54] AUTOMOTIVE HEADLIGHT

[75] Inventor: Matsuo Ichikawa, Gunma, Japan

[73] Assignee: Ichikawa Press Industries Co., Ltd., Takasaki, Japan

[21] Appl. No.: 931,190

[22] Filed: Aug. 4, 1978

[30] Foreign Application Priority Data

Mar. 29, 1978 [JP] Japan ..... 53/40561[U]

[51] Int. Cl.[3] ..... F21V 5/02

[52] U.S. Cl. ..... 362/308; 362/327; 362/339

[58] Field of Search ..... 354/297, 307, 308, 309, 354/311, 326, 327, 328, 333, 334, 335, 336, 337, 338, 339, 340

[56] References Cited

U.S. PATENT DOCUMENTS

| | | | |
|---|---|---|---|
| 1,338,675 | 5/1920 | Churchill | 362/309 |
| 1,604,213 | 10/1926 | Zorger | 362/309 |
| 1,604,935 | 10/1926 | Smith | 362/339 |
| 1,615,548 | 1/1927 | Michel | 362/309 |
| 1,802,524 | 4/1931 | Neil | 362/308 |
| 1,842,878 | 1/1932 | Nystrom | 362/334 |
| 1,929,111 | 10/1933 | Falge et al. | 362/297 |
| 1,954,806 | 4/1934 | Falge et al. | 362/297 |
| 2,012,806 | 8/1935 | Brown et al. | 362/309 |
| 2,142,964 | 1/1939 | Godley | 362/309 |
| 3,366,821 | 1/1968 | Kohl | 362/308 |

*Primary Examiner*—Donald A. Griffin
*Assistant Examiner*—Alan Mathews
*Attorney, Agent, or Firm*—Blanchard, Flynn, Thiel, Boutell & Tanis

[57] ABSTRACT

An auxiliary automotive headlight intended to secure the visual range in fog, rain, and snow. The filament of the lamp bulb is placed horizontally at the focus of a reflector in the shape of a paraboloid of revolution. At the front of the reflector there is provided a diffuser lens to diffuse the light in the horizontal direction. The diffuser lens has refracting parts which are thicker upwardly so that the light is diffused partially in the vertical direction as well as in the horizontal direction. These refracting parts are arranged according to the light distribution pattern or reflection at the upper part, lower part, diagonally left lower part, and diagonally right lower part around the filament. The refracting part formed according to the lower light distribution pattern has a higher refractive index in the vertical direction than the other parts and a lower refractive index in the horizontal direction than the others.

5 Claims, 16 Drawing Figures

Fig.5
PRIOR ART
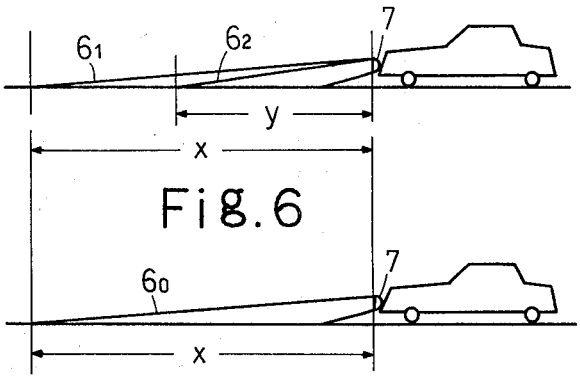
Fig.6
Fig.7
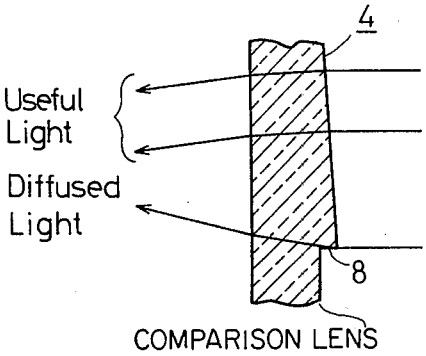
Fig.8
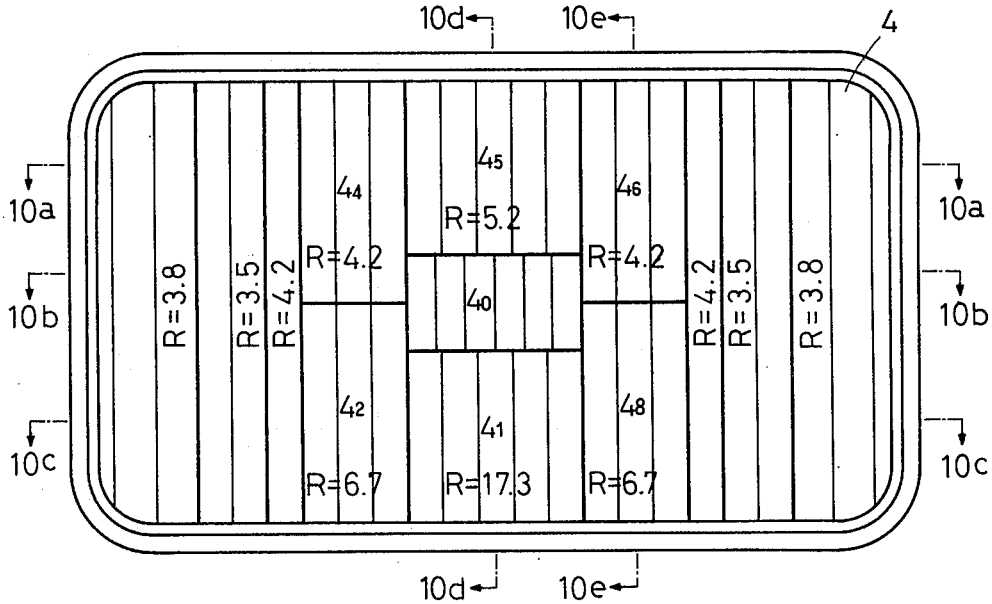
Fig.9
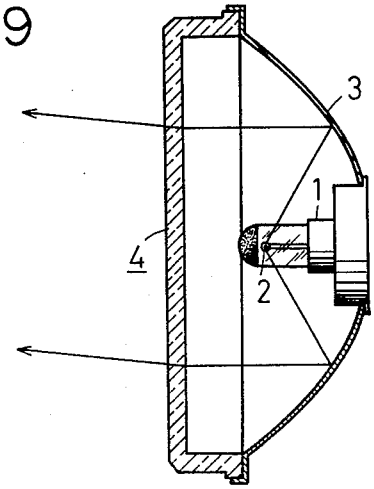

AUTOMOTIVE HEADLIGHT

BACKGROUND OF THE INVENTION

The present invention relates to an automotive headlight which is used to secure the visual range in fog, rain, and snow.

Usually, this kind of lighting apparatus has such a structure that the filament (2) of the lamp bulb (1) is placed horizontally at the focus of the reflector (3) in the form of a paraboloid of revolution and the diffuser lens (4) is placed in the horizontal direction at the front of the reflector, as shown in FIGS. 1 and 2.

In such a structure, a multiplicity of points ($p_1$)–($p_8$) are assumed on the reflector (3). They are ($p_1$) at lower part, ($p_2$) at diagonally left lower part, ($p_3$) at left part, ($p_4$) at diagonally left upper part, ($p_5$) at upper part, ($p_6$) at diagonally right upper part, ($p_7$) at right part, and ($p_8$) at diagonally right lower part. The respective independent light distribution patterns of the filament (2) at these points ($p_1$)–($p_8$) are as shown in FIG. 1 when the lens (4) is removed. In other words, if the light reflected at each point ($p_1$)–($p_8$) on the reflector (3) is projected on a vertical screen at a certain distance, with the front lens (4) removed, the shape of the filament (2) will be seen on the screen. Usually, these light distribution patterns ($P_1$)–($P_8$) overlap each other on the screen. This state is shown in FIG. 3. The square corner part (5) of each pattern ($P_1$)–($P_8$) is due to radiation of the leg (2') of the filament (2).

In FIG. 1, the samples of the light distribution patterns ($P_1$)–($P_8$) have been extracted from the eight points ($p_1$)–($p_8$) on the reflector (3). In actuality, the reflector (3) is an aggregate of an infinite number of points, and consequently the overlapped light distribution patterns are much more complex than FIG. 3. However, samples extracted from eight points are considered to represent the same light distribution patterns extracted from a multiplicity of points in view of the fact that the reflector (3) is a paraboloid of revolution and the sample points are equally spaced at the same radii from the focus, or the position of the filament.

The overlapped light distribution patterns ($P_1$)–($P_8$) as shown in FIG. 3 become as shown in FIG. 4 when diffused in a long, narrow strip in the horizontal direction by the front lens (4). The light distribution pattern (6) as shown in FIG. 4 has a disadvantage that the upper part ($6_1$) to ($6_2$) is dim and flat. When a headlight (7) having the light distribution pattern (6) is mounted on an automobile, the beam of the light is separated into two parts as shown in FIG. 5. Thus, if such a headlight (7) is mounted in such a manner that the upper edge ($6_1$) reaches the required distance (x), then the farthest edge ($6_2$) of the light flux of the required illumination reaches only the distance (y), resulting in a shortage of illumination. If the headlight (7) is positioned upward in order to get necessary illumination, then the headlight will cause dazzle to the driver in a car running in the opposite direction. This phenomenon results from the fact that the upper edges ($6_1$)($6_2$) do not coincide with each other and a dim part is formed at the overlapped light distribution patterns ($P_1$)–($P_8$) as shown in FIG. 3. This phenomenon is enhanced by the fact that the filament (2) of the lamp bulb (1) does not necessarily coincide with the focus of the reflector (3) or the filament (2) is not accurately horizontal.

One way of obviating such an undesirable phenomenon is to lower a little the diagonal light distribution patterns ($P_2$) ($P_4$) ($P_6$) ($P_8$) which project beyond a certain line in FIG. 3. In order to accomplish this, a part of the front lens (4) through which these light distribution patterns pass should be formed into a refracting part which becomes thicker downward as shown in FIG. 7. Then, the above-mentioned light distribution patterns ($P_2$) ($P_4$) ($P_6$) ($P_8$) would be lowered a little and all the upper edges would coincide with each other. However, the lens cutting as mentioned above could not accomplish the expected objective, because the lens cutting as shown in FIG. 7 gives rise to upward diffused light at the stepped part (8). This upward diffused light is extremely harmful for a small headlight about 15 cm in diameter which should illuminate the road several tens of meters ahead with sufficient illumination to permit the driver to confirm any obstacles, and yet should not cause dazzle to the driver in a car running in the opposite direction.

BRIEF SUMMARY OF THE INVENTION

This invention has been made in order to solve the above-mentioned problems. This invention provides a lens cut that raises the horizontal patterns at the upper and lower parts of the filament up to the upper edge of the diagonal light distribution pattern so that all the upper edges coincide with each other.

In order to raise the horizontal light distribution pattern, a refracting part is formed in the front lens in such a manner that the thickness is gradully increased upward. This makes the upper edge of the light distribution pattern very clear, and permits the effective light to cover the distance (x) sufficiently without causing dazzle to the driver in a car running in the opposite direction. And the diffused light caused by the stepped part points downward without causing any harm.

That part of the lens which corresponds to the part directly under the filament should be made such that the right and left diffusion angles are reduced more than at the other parts. In other words, the diameter R of the diffuser lens should be greater than at the other parts, and the refracting angle in the vertical direction should be greater than at the part directly above. Thus, the light that passes through this part is not diffused to the right and left so much but passes straight, and the light from the part directly under and the light from the part directly above cross each other. The light from the part directly under is intensified more. Therefore, the upper edge of the light distribution pattern becomes clear even when the filament is dislocated a little from the focus.

As will be apparent from the foregoing, the object of this invention is to obtain a light distribution pattern with a clear upper edge by means of a special fashion of lens cutting.

Another object of this invention is to provide a headlight in which the upper edge of the light distribution pattern is not affected even when the filament is dislocated a little.

A further object of this invention to provide a headlight of simple structure that gives an ideal provide a light distribution pattern.

Other objects and advantages of this invention will become readily apparent from the following description.

BRIEF DESCRIPTION OF THE DRAWING

FIG. 5 is a light distribution pattern of a conventional headlight.

FIG. 6 is a light distribution pattern of a headlight according to this invention.

FIG. 7 is a partial longitudinal sectional view of the diffuser lens.

FIG. 8 is a front view of the diffuser lens according to this invention.

FIG. 9 is a longitudinal sectional side elevation of a headlight according to this invention.

DETAILED DESCRIPTION OF THE INVENTION

Figure 1:
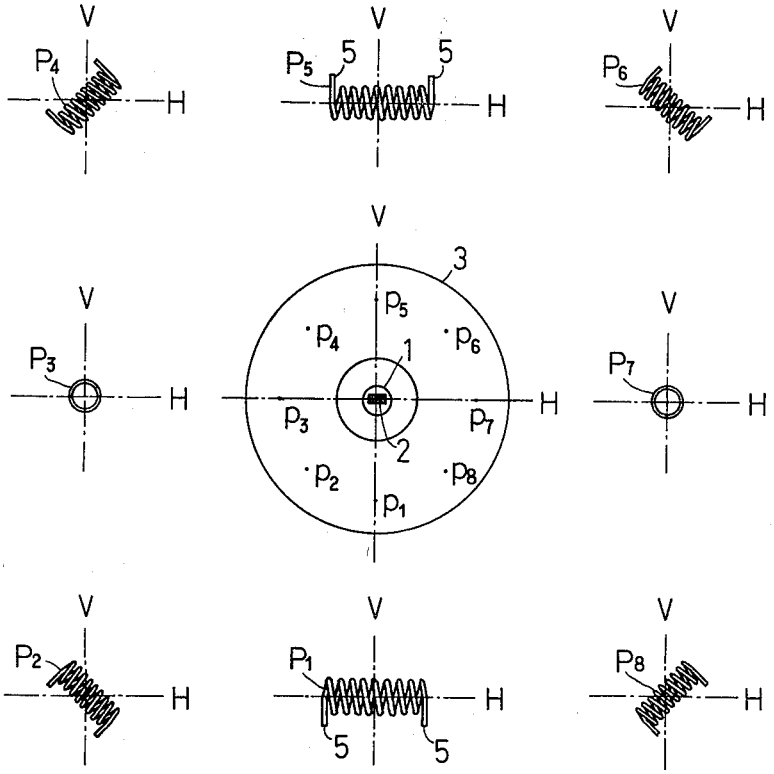
Fig.1 PRIOR ART
FIG. 1 is a front view of the reflector, with the lens removed, and light distribution patterns at each part ($p_1$)-($p_8$) on the reflector.
Figure 2:
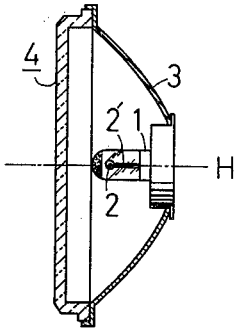
Fig.2 PRIOR ART
FIG. 2 is a longitudinal sectional view of a headlight as shown in FIG. 1.
Figure 3:
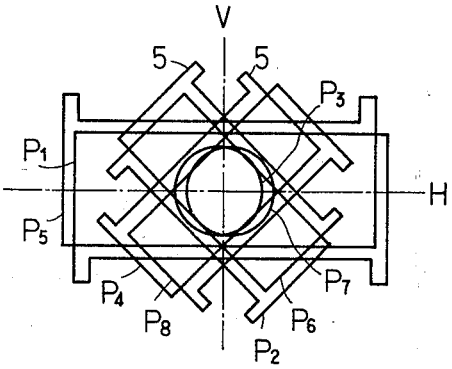
Fig.3 PRIOR ART
FIG. 3 is light distribution patterns of each part ($p_1$)-($p_8$) as shown in FIG. 1 which are projected on a vertical screen placed at a certain distance.
Figure 4:
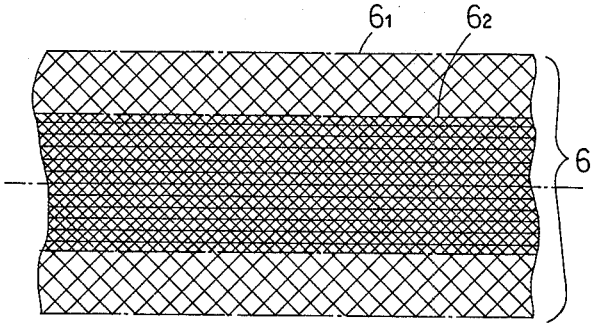
Fig.4 PRIOR ART
FIG. 4 a light distribution pattern obtained by diffusing horizontally the light distribution pattern of FIG. 3 by a diffuser lens.

This invention will be described referring to one example as shown in FIG. 8 and subsequent figures. The same numerals are given to the same parts in the conventional example.

Numeral (3) denotes the reflector of paraboloid of revolution. This reflector (3) is nearly rectangular as viewed from the front, with the upper and lower parts cut off. At the focus of the reflector (3) is provided horizontally on the filament (2) of the lamp bulb (1). At the front of the reflector (2) is provided a rectangular diffuser lens (4), which diffuses light in the lateral (right and left) directions by means of the inside arcs cut vertically at certain intervals. The rate of diffusion in the lateral directions is not the same over the entire surface of the diffuser lens, but is different from part to part as will be mentioned later.

Figure 10A:
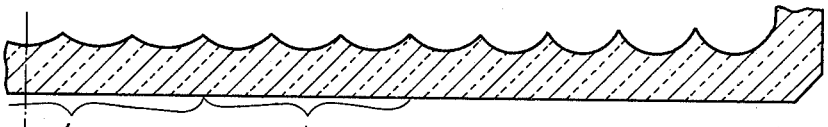
FIGS. 10*a*, 10*b*, 10*c*, 10*d*, and 10*e* are partially enlarged sectional views along the lines 10*a*—10*a*, 10*b*—10*b*, 10*c*—10*c*, 10*d*—10*d*, and 10*e*—10*e*, respectively, in FIG. 8.
Figure 10B:
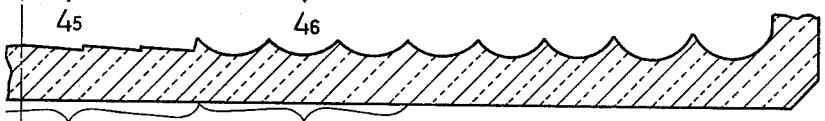
Figure 10C:
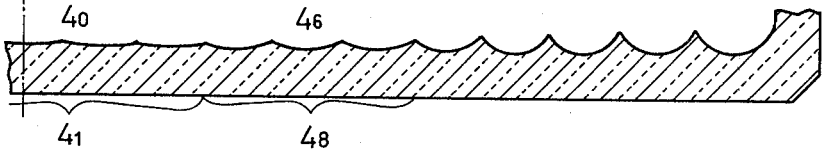
Figure 10D:
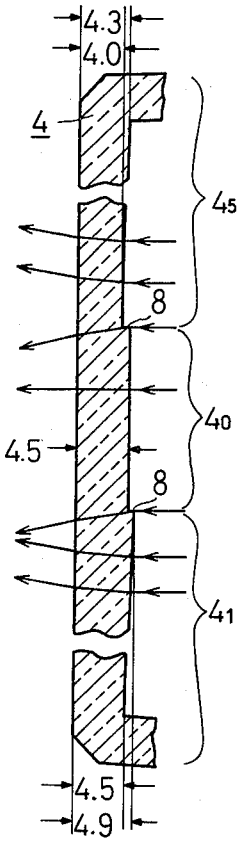
Figure 10E:
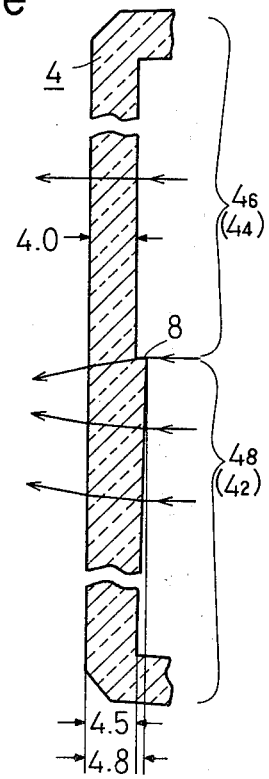

Points ($p_1$) to ($p_8$) are assumed on the reflecting surface of the reflector (3), as in FIG. 1. The major part of the lens is divided into six parts ($4_1$), ($4_2$), ($4_4$), ($4_5$), ($4_6$), and ($4_8$) in correspondence with the parts ($p_1$), ($p_2$), ($p_4$), ($p_5$), ($p_6$), and ($p_8$). The lower part ($4_1$) and the upper part ($4_5$) are tapered so that the thickness increases upwardly as shown in FIG. 10*d*. Similarly, the diagonally left lower part ($4_2$) and the diagonally right lower part ($4_8$) are tapered so the thickness increases upwardly as shown in FIG. 10*e*. These tapered surfaces form refracting parts that refract the light upward.

The refractive index in the vertical direction, or the ratio of the change of the thickness to the length, varies from one part to another. More specifically, it is 0.4/30=0.013 for the lower part ($4_1$), 0.3/30=0.01 for the upper part ($4_5$), and 0.3/38=0.0079 for the diagonally left and right parts ($4_2$) ($4_8$). The rate of diffusion in the right and left directions, or the curvature radius (R) also varies from one part to another. More specifically, R=17.3 for the lower part ($4_1$), R=5.2 for the upper part ($4_5$), R=6.7 for the diagonally left and right lower parts ($4_2$) ($4_8$), and R=4.2 for the diagonally left and right upper parts ($4_4$) ($4_6$). In addition, R=4.2, R=3.5, and R=3.8 for both ends excluding the central major parts of the lens (4).

The refractive index in the vertical direction for the lower part ($4_1$) is greater than that for the other parts, and the diffusion rate in the right and left directions is less than that of the other parts. This is because the upper edge of the light distribution pattern ($P_1$) of the lower part ($4_1$) forms a clear straight line and therefore the square part (5) of the light distribution pattern ($P_5$) of the upper part ($4_5$) and the projected part of the diagonal light distribution patterns ($P_2$), ($P_4$), ($P_6$), and ($P_8$) should be covered certainly. Thus, considerable effects are obtained if an upward refracting part is formed at the lower part ($4_1$) only.

The forward end of the lamp bulb (1) is provided with a hood (not shown) to shade the light that passes directly through the diffuser lens (4). Therefore, the central part ($4_0$) of the diffuser lens (4) is not necessary, and is provided with a cutting which has nothing to do with diffusion in the right and left directions. Usually, this part ($4_0$) is used for inscription of a trademark.

Figure 11:
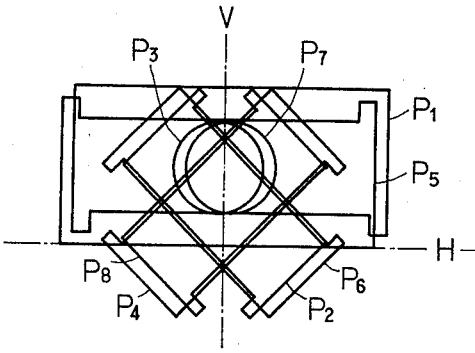
FIG. 11 is a light distribution pattern projected on a screen of the light distribution pattern at each part obtained when the diffuser lens refracts the light upward.
Figure 12:
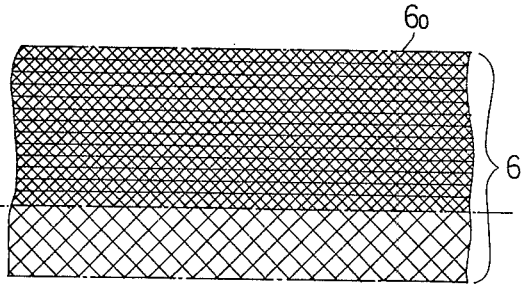
FIG. 12 is a light distribution pattern obtained by diffusing horizontally the light distribution pattern of FIG. 11 by a diffuser lens.

In such structure, the light emitted from the filament (2) is reflected by each part ($p_1$)-($p_8$) of the reflector, and the reflected parallel light is radiated after refraction by the diffuser lens (4). This diffuser lens (4) performs refraction in the vertical direction and lateral direction simultaneously. For easy understanding, the refraction in the vertical direction alone is discussed. As the light from each part ($p_1$)-($p_8$) passes through the diffuser lens (4), the corresponding light distribution patterns ($P_1$), ($P_2$), ($P_3$), ($P_5$), ($P_7$), and ($P_8$) are refracted upward by the upward refracting parts ($4_1$), ($4_2$), ($4_5$), and ($4_8$) of the diffuser lens (4). If this light is projected on a vertical screen several tens of meters away, the upper edge ($6_0$) will form a straight line as shown in FIG. 11. This is changed to the light distribution pattern with distinct upper edge ($6_0$) as shown in FIG. 12 by the diffusion in the right and left directions.

The step (8) is formed at the upward refracting part of the lens (4), and the light refracted by this step (8) is directed downward and no harmful effect is caused. Rather, it illuminates effectively the road surface near the car.

An automotive headlight of this structure eliminates the upward light completely, and causes no dazzle to the driver in a car running in the opposite direction or causes no ligh film phenomenon even when the sufficient illumination is given to cover the required distance (x).

The reflector (3) and the lens (4) are not limited to rectangular shapes.

Specific numerals were given to the lens (4) in the example, but this invention is not limited to them.

What is claimed is:

1. An automotive headlight, comprising: a concave reflector having a reflecting surface in the shape of a paraboloid of revolution; a light source having a horizontal filament located substantially at the focus of said reflecting surface so that light from said filament is reflected forwardly as parallel horizontal rays from said reflecting surface; a diffuser lens covering the open forward end of said reflector, said diffuser lens having means for effecting horizontal diffusion of light reflected from said reflecting surface, said diffuser lens also having an upwardly refracting prism part so that the upper edges of the light distribution patterns from each part of said reflecting surface substantially coincide with each other at a location spaced a selected distance horizontally forwardly from said lens, said upwardly refracting prism part increasing in thickness in the upward direction.

2. An automotive headlight as recited in claim 1 wherein said upwardly refracting prism part is in the lower portion of said diffuser lens and is located horizontally below said filament for refracting upwardly light reflected from the lower portion of said reflecting surface.

3. An automotive headlight as recited in claim 2 in which the refractive index in the horizontal direction of said upwardly refracting prism part is lower than the refractive index in the horizontal direction of the remainder of said diffuser lens.

4. An automotive headlight, comprising: a concave reflector having a reflecting surface in the shape of a paraboloid of revolution; a light source having a horizontal filament located substantially at the focus of said reflecting surface so that light from said filament is reflected forwardly as parallel horizontal rays from said reflecting surface; a diffuser lens covering the open forward end of said reflector, said lens having a horizontal top central prism part, a horizontal bottom central prism part located vertically below said horizontal top central prism part, horizontal top lateral prism parts on opposite lateral sides of said horizontal top central prism part and horizontal bottom lateral prism parts on opposite lateral sides of said horizontal bottom central prism part, said prism parts having means for refracting light horizontally, said horizontal bottom central prism part and said horizontal bottom lateral prism parts having upwardly refracting surfaces which increase in thickness in the upward direction and refract light upwardly to a greater extent than said horizontal top central prism part and said horizontal top lateral prism parts so that the upper edges of the light distribution patterns from each part of said reflecting surface substantially coincide with each other at a location spaced a selected distance horizontally forwardly from said lens, said horizontal bottom central prism part and said horizontal bottom lateral prism parts having a lower refractive index in the horizontal direction than said horizontal top central prism part and said horizontal top lateral prism parts.

5. An automotive headlight as recited in claim 4 in which said lens has a vertically and horizontally central part extending from the upper edge of said horizontal bottom central prism part to the lower edge of said horizontal top central prism part, said vertically and horizontally central part being of uniform thickness and being free of means for refracting light horizontally, the thickness of said vertically and horizontally central part being less than the thickness of the upper edge of said horizontal bottom central prism part and greater than the thickness of the lower edge of said horizontal top central prism part, the junctures of the upper edge of said vertically and horizontally central part with the lower edge of said horizontal top central prism part and of the lower edge of said vertically and horizontally central part with the upper edge of said horizontal bottom central prism part defining forwardly extending shoulders, both of said horizontal bottom central prism part and said horizontal top central prism part progressively increasing in thickness from the lower edge to the upper edge thereof, respectively, with said horizontal bottom central prism part having a greater difference in thickness between the upper and lower edges thereof than the corresponding difference for said horizontal top central prism part, said horizontal top lateral prism parts being of uniform thickness and said horizontal bottom lateral prism parts being of progressively increasing thickness from the bottom edge to the top edge thereof with the thickness of the top edges of said horizontal bottom lateral prism parts being greater than the thickness of the lower edges of said horizontal top lateral prism parts, the junctures of the top edges of said horizontal bottom lateral prism parts with the lower edges of said horizontal top lateral prism parts defining forwardly extending shoulders.

* * * * *